US006513192B1

(12) United States Patent
Pearlstein

(10) Patent No.: US 6,513,192 B1
(45) Date of Patent: Feb. 4, 2003

(54) VACUUM NOZZLE TOOL AND STAIN REMOVAL METHOD

(76) Inventor: Dennis L. Pearlstein, 8130 W. Walker Dr., Littleton, CO (US) 80123

( * ) Notice: Subject to any disclaimer, the term of this patent is extended or adjusted under 35 U.S.C. 154(b) by 0 days.

(21) Appl. No.: 09/579,833

(22) Filed: May 26, 2000

Related U.S. Application Data

(60) Provisional application No. 60/136,645, filed on May 27, 1999.

(51) Int. Cl.[7] ..... A47L 9/02

(52) U.S. Cl. ..... 15/415.1; 15/420; D32/32

(58) Field of Search ..... 15/414, 415.1, 15/416, 417, 420; 34/8, 58, 68; 68/19; D32/25, 22, 31, 32, 33

(56) References Cited

U.S. PATENT DOCUMENTS

| | | | | |
|---|---|---|---|---|
| 100,383 | A | | 3/1870 | Duval |
| 1,042,713 | A | * | 10/1912 | Moorehead |
| 1,066,210 | A | * | 7/1913 | Fulper |
| 1,192,409 | A | | 7/1916 | Frame |
| 1,821,715 | A | * | 9/1931 | Kuchinsky |
| 1,929,345 | A | * | 10/1933 | Brown et al. |
| 2,240,005 | A | * | 4/1941 | Moyer |
| 2,280,751 | A | | 4/1942 | Davis |
| 2,635,277 | A | * | 4/1953 | Belknap |
| 2,785,432 | A | | 3/1957 | Rockwell |
| 3,345,672 | A | * | 10/1967 | Mers et al. |
| 3,360,816 | A | | 1/1968 | Fontecchio |
| 3,605,171 | A | * | 9/1971 | Candor et al. |
| 3,780,398 | A | | 12/1973 | Candor |
| 4,161,802 | A | * | 7/1979 | Knight et al. |
| 4,263,693 | A | * | 4/1981 | Mekelberg |
| 4,677,705 | A | * | 7/1987 | Schuster |
| 4,875,249 | A | * | 10/1989 | Collier |
| 5,134,748 | A | * | 8/1992 | Lynn |
| 5,398,361 | A | | 3/1995 | Cason |
| 5,577,293 | A | * | 11/1996 | Meredith et al. |
| 5,706,548 | A | * | 1/1998 | Schabacker |
| 6,029,310 | A | * | 2/2000 | Besel |
| 6,080,243 | A | * | 6/2000 | Insley |
| 6,131,236 | A | * | 10/2000 | Roth |

FOREIGN PATENT DOCUMENTS

| | | | |
|---|---|---|---|
| DE | 12380 | | 8/1880 |
| GB | 2078496 | * | 1/1982 |
| JP | 5-33476 | * | 2/1993 |

* cited by examiner

*Primary Examiner*—Frankie L. Stinson
(74) *Attorney, Agent, or Firm*—Brian D. Smith, P.C.

(57) ABSTRACT

A vacuum nozzle or suction head for efficiently and effectively removing standing liquid from fabric surfaces such as carpeting. The nozzle is formed by a nozzle body defining an internal enclosed vacuum chamber and an upper vacuum source port opening into the chamber. A sleeve adapted to receive a vacuum source tube is affixed to the nozzle body and opens into the port. The nozzle body has a bottom plate defining an outer bottom surface with a plurality of vacuum suction ports opening between the chamber and the bottom surface. Each port has a throat portion opening into the chamber and an outer enlarged portion opening into the surface. Moving the nozzle, when connected to a suction source, across a liquid saturated, typically water saturated surface effects removal of water therefrom.

7 Claims, 1 Drawing Sheet

VACUUM NOZZLE TOOL AND STAIN REMOVAL METHOD

CROSS REFERENCE TO RELATED APPLICATIONS

This application is a nonprovisional application claiming the benefit under 35 USC 119(e) of U.S. provisional application Ser. No. 60/136,645, filed May 27, 1999.

FIELD OF THE INVENTION

The present invention relates to nozzles or suction heads for vacuum apparatus.

BACKGROUND OF THE INVENTION

A wide variety of nozzles or suction heads for vacuum cleaners and vacuum apparatus are old and well-known in the art. U.S. Pat. No. 1,000,383 issued Aug. 15, 1911, to O. Drake for "Shoe for Vacuum Cleaners" shows a vacuum nozzle or shoe for a vacuum cleaner. This nozzle includes an interior vacuum chamber and a bottom plate with slots or openings therein. The slots include stock or wedding, apparently to prevent dirt from dropping back through the slots when the vacuum cleaner is not running. U.S. Pat. No. 5,398,361, issued Mar. 21, 1995, to K. Cason for "Vacuum Cleaner for Submerged Non-Parallel Surfaces" discloses a vacuum pool cleaner with a nozzle having an open bottom face. U.S. Pat. No. 2,280,751, issued Apr. 21, 1942, to H. Davis for "Vacuum Cleaner Nozzle" discloses a vacuum cleaner nozzle having a plurality of slots in a bottom plate opening through the plate into a relatively deep vacuum nozzle chamber leading directly to the vacuum hose. The nozzle is intended for dry vacuuming, being provided with an electrostatic bottom plate.

OBJECTS OF THE INVENTION

The principal object of the present invention is to provide an improved nozzle or suction head finding particular but not necessarily exclusive utility for vacuum removal of water or other liquids from a surface such as a carpet and/or fabrics including upholstery, padding, garments, mattress and wall coverings, etc.

Another object of the present invention is to provide a nozzle or suction head of the foregoing character which efficiently and rapidly removes standing water, stain removal solutions and other liquids from fabric or carpeting installed on a floor.

A further object of the present invention is to provide an improved nozzle or suction head of the foregoing character which increases the flow of water therethrough upon the application of suction to facilitate rapid and thorough removal of water and thereby prevent moisture damage to a carpet, its pad and/or floor.

SUMMARY OF THE INVENTION

The present invention is embodied in an efficient vacuum nozzle for removing liquid from a surface which may be almost any surface. It works well on carpeting and extremely well on padded carpeting.

The nozzle or suction head is formed by a nozzle body defining a shallow, internal, enclosed vacuum chamber. A vacuum source connector is in fluid communication with the chamber and is adapted to receive a vacuum source conduit or hose.

The nozzle body also defines an outer bottom surface and a plurality of vacuum suction ports opening between the chamber and the nozzle body's bottom surface. As such, when the nozzle is connected to a vacuum source, its movement across a water or fluid saturated surface effects removal of water therefrom through the ports and chamber to the vacuum source.

Each port preferably has a throat portion opening into the chamber and a conical outer enlarged portion opening into the bottom surface. In a preferred embodiment of the nozzle, the outer surface of the vacuum source connector serves as a handle for the nozzle.

DESCRIPTION OF PREFERRED EMBODIMENTS

Figure 1:
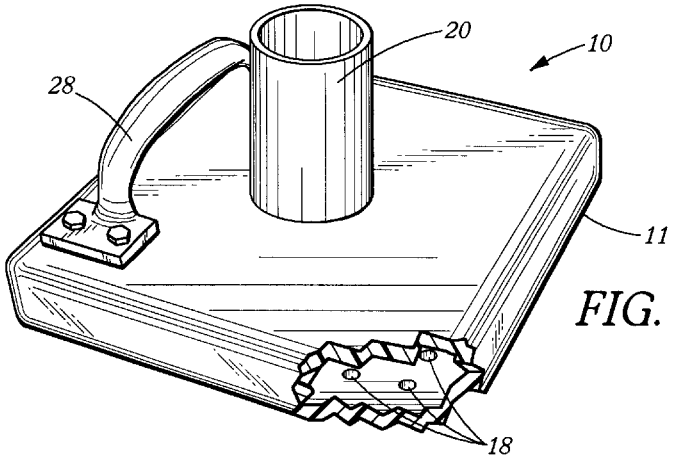
FIG. 1 is a front perspective view of a nozzle or suction head embodying the present invention with a portion cut away for clarity.

The present invention is embodied in an improved nozzle or suction head 10 finding particular but not necessarily exclusive utility for rapidly removing standing water from floors, particularly carpeted floors, following either accidental flooding or purposeful flooding, i.e. water saturation, for spotting and cleaning purposes. The nozzle 10 is formed as a hollow, preferably generally rectangular body 11 having an upper plate or wall 12, a bottom plate or wall 14, and side walls 15 defining a shallow, enclosed vacuum or suction chamber 16. The bottom plate 14 defines a plurality of suction ports 18 opening into the bottom surface 19 of the nozzle 10.

For applying suction to the suction chamber 16, a vacuum source connector such as a suction sleeve or tube 20 opens through a port 21 in the top plate 12 and receives an inserted end of a suction wand, tube, hose or conduit 22 connected to a vacuum or suction producing and water collecting apparatus (not shown). As such, the vacuum source connector is in fluid communication with the chamber, thereby enabling a vacuum to be established in the chamber when a vacuum hose is attached to the connector and the vacuum source, i.e. suction producing apparatus, is activated.

The suction ports 18 are defined by a throat portion 24 opening into the water chamber 16, and a tapered or cylindrical counterbore 25 opening into the outer surface 19 of the base plate 14.

Figure 4:
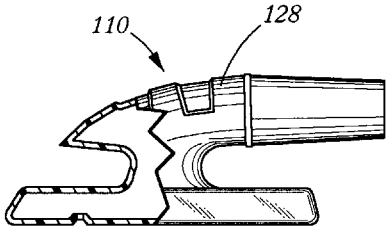
FIG. 4 is a side elevation view of another nozzle or suction head of the present invention with a portion also cut away for clarity.

To facilitate moving the nozzle or suction head 10 across a surface such as carpet 26 against the friction forces between the carpet surface 26 and the suction head surface 19, a handle 28 or set of handle supporting brackets (not shown) is provided on the nozzle 10. Alternatively, the handle may be incorporated as a part of the vacuum connector as shown in FIG. 4.

In use, the nozzle 10 is connected to a vacuum tube, wand, hose or conduit 22 by inserting an end thereof into the upwardly extending fitting tube 20 on the nozzle body 11. The vacuum and water or solution collecting device (not shown but known to those skilled in the art) is turned on to provide a vacuum or suction, causing air to flow through the nozzle ports 18 in to the chamber 16. When the nozzle is applied to a water-soaked surface such as a carpet, water is sucked through the ports 18 into the chamber 16 and then through the outlet port 21 and tube 20 into the vacuum hose or tube through which it flows to the collection device. In this manner, water is rapidly and efficiently removed from the carpet and its padding 29 (or other surface) by moving the nozzle 11 along the surface, using the handle 28 to apply the necessary sliding force.

The nozzle may be constructed of plastic, such as a high impact moldable plastic, polycarbonate for example, or a lightweight metal such as aluminum. The nozzle is preferably formed by a pair of spaced plates forming the upper and lower plates 12, 14, joined by a hollow frame defining the side walls 15 and establishing the depth of the chamber 16. The chamber 16 must be of a size and depth so that it provides adequate suction and water flow, and of a depth sufficiently shallow to preclude collection of water therein.

The plates and side wall frame may be welded or glued together or secured together with appropriate fasteners such as screws with any necessary seal such as a gasket or o-ring.

The nozzle 10 thus formed may be square, rectangular, elongated, circular, elliptical or the like. The ports 18 may be arranged thereon in any suitable pattern, including columns and rows, a random arrangement, a spiral, concentric circles, or other appropriate geometric design. The outlet portion 25 of the ports 18 may be conical, semi-spherical, cylindrical or other appropriate shape or configuration. The bottom surface 19 of the nozzle into which the suction ports 18 open is relatively smooth and free of projections in order to permit the suction device 10 to be readily moved across the surface of the carpet or floor without biting into the carpet or floor 18.

The suction hose receiving sleeve or tube 20 on the upper plate 12 of the nozzle or suction head 11 may be at any position thereon, and may be either perpendicular or at an angle to the surface of the upper plate 12. The handle 28 may be short or long, or a bracket may be provided for attaching a long or short handle to the nozzle.

Figure 2:
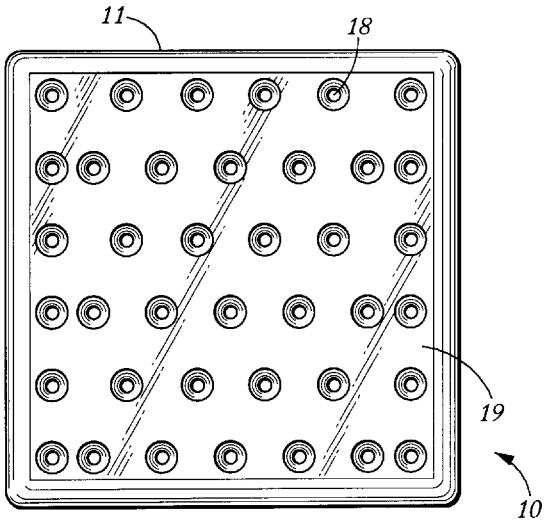
FIG. 2 is a bottom plan view of the nozzle or suction head embodying the present invention head shown in FIG. 1.
Figure 3:
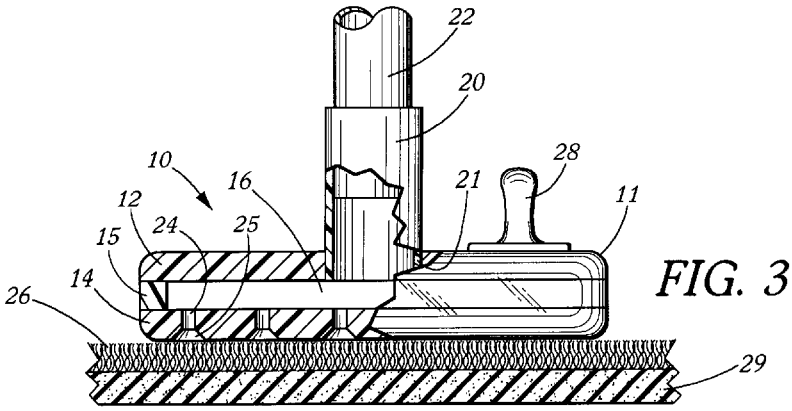
FIG. 3 is a side elevation view of the nozzle or suction head shown in FIG. 1 with a portion cut away for clarity.

In one preferred form as shown in FIGS. 1–3, the nozzle or suction head is formed of high impact plastic such as thermoplastic resin, with square upper and lower walls of 8 in.×8 in. and a thickness of ½ inch. The side wall forming spacer has of a thickness of ½ inch and provides a chamber of a depth of approximately ½ inch. The edges or corners of the nozzle materials are rounded in order to present catching and dragging on carpet. When the nozzle is formed of plastic material, a liquid glue or solvent can be utilized to securely fasten the pieces together in vacuum-tight and watertight relation. Vacuum water collecting sources suitable for attachment to the nozzle include any wet/dry shop vac, any portable carpet cleaning machine and any truck mounted carpet cleaning machine as such are known to those skilled in the art.

The nozzle or suction head may be utilized to remove spots or stains on carpeting by purposefully flooding the stained area with water and stain remover, allowing the water/stain remover solution to set for a period of time (30 seconds to 72 hours) which is sufficient to saturate the stained area of the carpet, and then vacuuming the liquid from the carpeting and its padding (or other surface particularly fabrics as discussed above) with a nozzle preferably embodying the present invention.

The stain remover should be of a type for removing the particular stain being treated. For example, if pet or urine stain is to be removed suitable stain removers include Nature's Miracle available from Pets and People, Inc. of Rolling Hills Estates, Calif. and Aqua Pet Zyme available from Innovative Products of Englewood, Colo. These products should be mixed with water in accordance with the product's instructions which when mixed provide the above water/stain remover solution.

It has been observed that a nozzle constructed as described above is capable of removing approximately 98 percent of the solution utilized from the carpeting and doing it very quickly.

In accordance with a preferred embodiment of the method of the present invention, at least 50% of the solution is vacuumed out of the carpeting, preferably between about 70 and 98%. In addition and as alluded to above, the method of the present invention is capable of quickly removing solution from the carpeting (including the padding). Indeed, it has been found that (depending on the thickness and density of the carpeting and padding) 70% or more of the water or solution can be removed (or vacuumed) from the carpeting (including the padding) at rates of less than two minutes per square foot. Less than one minute per square foot is also easily achievable. In fact, if the vacuum source is strong enough (for example, similar to that provided by a truck mounted system known to those skilled in the art) rates of less than 30 seconds per square foot have been found to remove up to 98% of the liquid from the carpeting (and its padding).

Vibration devices such as a rotary head device known to those skilled in the art may be applied to the nozzle to enhance water extraction. Further enhancement of water extraction can be obtained by making the device large and strong enough to allow a user to stand on it. This increases pressure on the carpet which enhances liquid removal.

FIG. 4 illustrate another nozzle 110 of the present invention which is similar to nozzle 10 of FIGS. 1 through 3 except that handle 28 and suction connector sleeve 20 have been replaced by a single suction handle 128. As will be appreciated, suction handle 128 serves as, i.e. provides the functions of, both handle 28 and connector sleeve 20.

While certain illustrative embodiments of the present invention have been shown in the drawings and described above in detail, it should be understood that there is no intention to limit the invention to the specific form disclosed. On the contrary, the intention is to cover all modifications, alternative constructions, equivalents and uses falling within the spirit and scope of the invention as expressed in the appended claims. Such modifications could include, for example, slit shaped, slot-like or oval shaped ports or any other shape providing good water extraction.

I claim:

1. A vacuum nozzle for removing liquid from surfaces, comprising:

a nozzle body defining an internal enclosed vacuum chamber wherein said chamber is of a size and shallow depth so as to enhance water flow therethrough, said nozzle body also having a vacuum source connector in fluid communication with said chamber and adapted to receive a vacuum source conduit, and said nozzle body also having a generally flat, smooth and hard outer bottom surface and defining a plurality of vacuum suction ports opening between said chamber and said bottom surface;

whereby moving said nozzle when connected to a suction source across a water saturated surface effects removal of water therefrom through said ports and chamber to said vacuum source.

2. A vacuum nozzle as claimed in claim 1 wherein said vacuum source connector defines a outer surface which is sized and configured to serve as a handle for said nozzle.

3. A vacuum nozzle for removing liquid from surfaces, comprising:

a nozzle body defining an internal enclosed vacuum chamber wherein said chamber is of a size and shallow depth so as to enhance water flow therethrough, said nozzle body also defining an upper vacuum source port opening into said chamber;

a vacuum source connector affixed to said nozzle body and opening into said port and adapted to receive a vacuum source hose; and said nozzle body having a bottom plate defining a generally flat, smooth and hard outer bottom surface;

said bottom plate defining a plurality of vacuum suction ports opening between said chamber and said bottom surface, each said port having a throat portion opening into said chamber and an outer enlarged portion opening into said surface;

whereby moving said nozzle when connected to a suction source across a water saturated surface effects removal of water therefrom through said ports and chamber to said vacuum source.

4. A vacuum nozzle as defined in claim 3 wherein said outer portion of said suction ports is conical in configuration.

5. A vacuum nozzle for removing liquid from surfaces, comprising:

a nozzle body defining an internal enclosed vacuum chamber wherein said chamber is of a size and shallow depth so as to enhance water flow therethrough, said nozzle body also defining an upper vacuum source port opening into said chamber;

a connector affixed to said nozzle body and opening into said port and adapted to receive a vacuum source hose;

a handle secured to and extending upwardly from said nozzle body; and said nozzle body having a bottom plate defining a generally flat, smooth and hard outer bottom surface, said bottom plate defining a plurality of vacuum suction ports opening between said chamber and said bottom surface, each said port having a throat portion opening into said chamber and an outer enlarged portion opening into said surface, whereby moving said nozzle when connected to a suction source across a water saturated surface effects removal of water therefrom through said ports and chamber to said vacuum source.

6. A vacuum nozzle as defined in claim 5 wherein said outer portion of said suction ports is conical in configuration.

7. A vacuum nozzle as defined in claim 5 wherein said chamber has a depth of about ½ inch.

* * * * *